US008167170B2

(12) United States Patent
Choiniere et al.

(10) Patent No.: US 8,167,170 B2
(45) Date of Patent: May 1, 2012

(54) ADHESIVE DISPENSER SYSTEM

(75) Inventors: Stanley W. Choiniere, Southwick, MA (US); Joshua S. Kelly, Longmeadow, MA (US)

(73) Assignee: Handy & Harman, Rye, NY (US)

( * ) Notice: Subject to any disclaimer, the term of this patent is extended or adjusted under 35 U.S.C. 154(b) by 486 days.

(21) Appl. No.: 11/818,451

(22) Filed: Jun. 14, 2007

(65) Prior Publication Data

US 2008/0000928 A1 Jan. 3, 2008

Related U.S. Application Data

(60) Provisional application No. 60/813,788, filed on Jun. 15, 2006.

(51) Int. Cl.
*B65D 35/22* (2006.01)

(52) U.S. Cl. ..... 222/94

(58) Field of Classification Search ..... 222/94, 222/105–107, 129, 129.1, 145.1–145.8, 181–184, 222/185.1–185.3, 100, 131–137; 229/117.09–117.17, 117.27–117.35
See application file for complete search history.

(56) References Cited

U.S. PATENT DOCUMENTS

| | | | | |
|---|---|---|---|---|
| 3,042,271 | A | 7/1962 | Winstead | |
| 3,599,840 | A | 8/1971 | Speas | |
| 4,174,051 | A * | 11/1979 | Edwards et al. | 222/105 |
| 5,147,062 | A * | 9/1992 | Heuberger et al. | 229/117.27 |
| 5,255,713 | A * | 10/1993 | Scholle et al. | 137/614.04 |
| 5,477,883 | A * | 12/1995 | Totten | 137/614.03 |
| 5,562,227 | A * | 10/1996 | Takezawa et al. | 229/117.13 |
| 5,566,851 | A * | 10/1996 | Sasaki et al. | 229/117.27 |
| 5,878,915 | A * | 3/1999 | Gordon et al. | 222/82 |
| 5,911,403 | A * | 6/1999 | deCler et al. | 251/149.6 |
| 6,294,761 | B1 * | 9/2001 | Diederich et al. | 219/386 |
| 6,848,599 | B2 * | 2/2005 | Hammarth et al. | 222/105 |
| 7,344,052 | B2 * | 3/2008 | Light | 222/105 |
| 2003/0196703 | A1 * | 10/2003 | DeCler et al. | 137/538 |
| 2006/0278656 | A1 * | 12/2006 | Ross | 222/105 |

OTHER PUBLICATIONS

Lauren R. Hartman, Packaging Digest, Nov. 1997, pp. 44, 45 and 52.

* cited by examiner

*Primary Examiner* — Lien Ngo
(74) *Attorney, Agent, or Firm* — Alix, Yale & Ristas, LLP

(57) ABSTRACT

A dispenser system employs a packaging module for use with moisture sensitive materials. The packaging module comprises an outer carton and an inner bladder, which is substantially impermeable to moisture and is filled with one part of an adhesive. The carton is loaded on a mobile cart and the one part adhesive is supplied to a pump/mixer without exposure to moisture in the atmosphere. The packaging and dispensing system can be used in conjunction with mechanized adhesive application equipment for the construction trades.

17 Claims, 8 Drawing Sheets

ADHESIVE DISPENSER SYSTEM

CROSS-REFERENCE TO RELATED APPLICATION

This application claims the priority of U.S. Provisional Application 60/813,788 filed on Jun. 15, 2006, the disclosure of which is incorporated by reference.

FIELD OF THE TECHNOLOGY

This application is directed to a packaging system for moisture-sensitive materials, and more particularly, to a dispensing system for moisture-sensitive adhesive materials used in the construction industry.

BACKGROUND OF THE INVENTION

In the construction industry, most moisture-sensitive materials, such as adhesive components, are packaged in a variety of sealable containers to prevent the contents from absorbing water from the atmosphere or moisture that collects on the surfaces of dispensing systems. Moisture commonly migrates into the fittings, nozzles and conduits of such dispensing systems. The dispensing system becomes clogged and the dispensing qualities are degraded to the extent that the system must be disassembled and cleaned. Significant costs and inefficiencies result from having to remove moisture which collects in the components of the dispensing system.

If the moisture-sensitive material is to remain viable over time, the user has to make sure that the packaging is tightly closed during periods of non-use. However, moisture-sensitive materials are inherently difficult to store after opening the original packaging, so in many cases, the unused portion is discarded after a construction job is completed. If moisture-sensitive materials are not discarded after opening the primary container, the material begins to chemically degrade, which can negatively affect the performance and physical properties of the remaining material. Additionally, the necessity of routinely discarding the unused portions of moisture-sensitive materials is costly, inconvenient, and environmentally unsound.

SUMMARY

An adhesive dispenser system for moisture-sensitive materials, such as construction adhesives, is provided. The adhesive dispenser system employs a packaging module which protects the contents therein from moisture in the atmosphere during use as well as during pre- and post-use storage and shipping. In one preferred embodiment, a packaging module comprises an outer container body or carton and an inner bag or bladder made of a water-impermeable flexible sheet material. The bladder has a truncated spout which is closed by a cap which is preferably valved. The bladder is filled with one part of an adhesive. The outer container body is preferably equipped with a handle, an opening to provide access to the spout and a window to allow inspection of the contents remaining in the bladder. The packaging module is adapted for efficient use with mechanical or motorized applicator systems.

The inner bladder receives and contains the moisture-sensitive material during shipping, use, and storage. It is also preferred that the spout has sidewalls extending upwardly to form a ridged neck portion and that the cap be threaded to the spout. Preferably, the spout and cap are manufactured from a durable plastic material. The spout can be closed or sealed either by use of a valved cap or similar sealing means. The spout via the cap is re-sealable after a first use such that the material therein remains in substantially the same condition as it was upon the first opening or first use of the material.

Briefly stated, one embodiment of a dispensing apparatus for a two-part adhesive comprises a cart having a tray. The carts mount a pump assembly which has a pair of inlets and a pair of outlets which communicate with a mixer/applicator gun. A first package encloses a bladder with an opening and which contains a first adhesive component. A second package encloses a bladder with a second opening and which contains a second adhesive component. The packages are each received on the tray. A conduit communicates via a first valve connector assembly between the opening of the package assembly and an inlet to the pump. A second conduit communicates via a second valve connector assembly between an opening of the second package and a second inlet to the pump. The first and second adhesive components are pumped by the pump assembly to a mixer/gun assembly and dispensed therefrom.

At least one package has a corrugated configuration. The package has a general rectangular shape with a handle mounted at one side. The package also has a window to permit inspection of the adhesive component contained in the corresponding bladder. The tray has a retention flange which surrounds the packages with the first and second packages being generally aligned in adjacent side disposition on the tray. At least one of the connector assemblies upon connection to the conduit does not permit exposure of the component in the bladder to the atmosphere. The connector assembly comprises a poppet valve and a snap-fit type connection. The snap-fit type engagement closes off the corresponding opening upon disconnecting the associated conduit from the opening. A hose connects the outlet to a mixer. The cart may further have a pair of wheels and handlebars for facilitating movement across a surface.

A method of dispensing a moisture sensitive adhesive with a mobile applicator system comprises providing a package having an outer container and an inner flexible enclosure that is substantially impermeable to moisture. The enclosure has an opening and is closed by a cap. The enclosure contains one part of an adhesive. The package is inverted. The package is then loaded onto a tray of the mobile applicator system. A conduit is connected for communication through the opening without exposing the one part to the atmosphere. The one part is mixed with the second part to form an adhesive and the adhesive is dispensed under pressure for application.

The conduit connecting step may employ lifting a valve to permit communication of one part into the conduit and implementing a snap fit connection between fittings of the cap and the conduit. The conduit may be disconnected from communication with the opening without exposing the one part in the inner enclosure to the atmosphere.

A packaging module comprises a carton having a box-like shape with one side having an opening. A water impermeable enclosure is disposed in the carton and has a spout alignable with or disposed in the opening and enclosed by a cap with a valve. A moisture sensitive part of the adhesive is disposed in the enclosure. A second side of the carton has a cutout portion defining a window. A handle extends from the first side. The carton preferably has a corrugated construction.

A better understanding will be obtained from the following detailed description of the presently preferred, albeit illustrative, embodiments of the adhesive dispenser invention.

DETAILED DESCRIPTION OF THE PREFERRED EMBODIMENTS

An adhesive dispenser system is adapted for use with for moisture sensitive materials, such as two-part polyurethane adhesives used in the construction trades. For example, one commonly used chemical component for adhesive for which the system has particular applicability is methylene diphenyl diisocyanate (MDI)-which is moisture sensitive. The adhesive dispenser system, designated generally as 10, employs at least one packaging module 11 which protects the pre-mixed components from moisture in the atmosphere, prevents the escape of volatile materials and ultimately substantially prevents, if not eliminates, crystallization in the pump, mixing components, conduits, delivery hoses and fixtures. The adhesive dispenser system 10 is used to facilitate the mixing and dispensing of moisture sensitive materials, as well as to ensure material integrity during shipping, pre-use storage and post-use storage.

Figure 6:
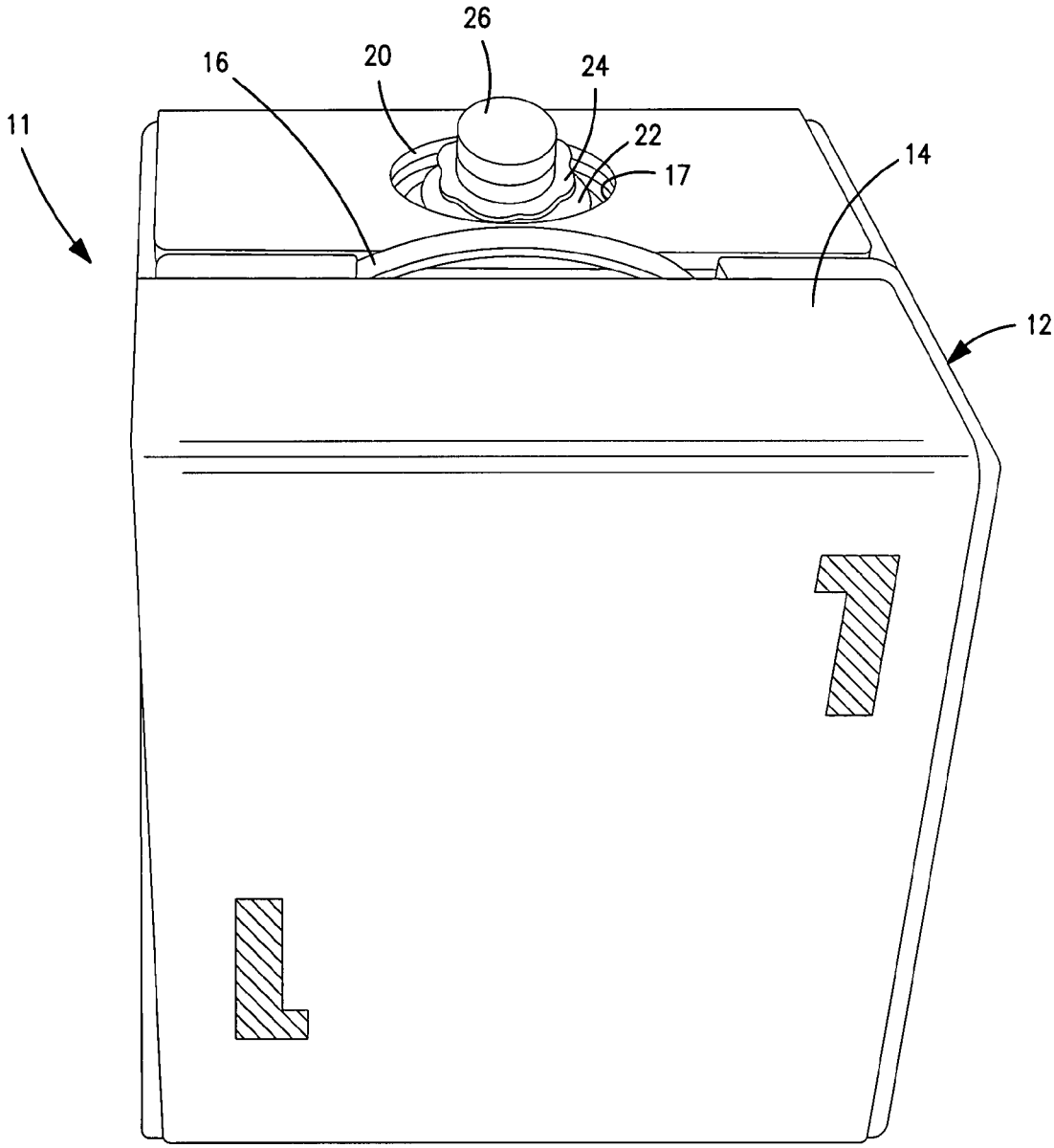
FIG. 6 is a frontal perspective view of a packaging module which may be employed in the adhesive dispenser.
Figure 7:
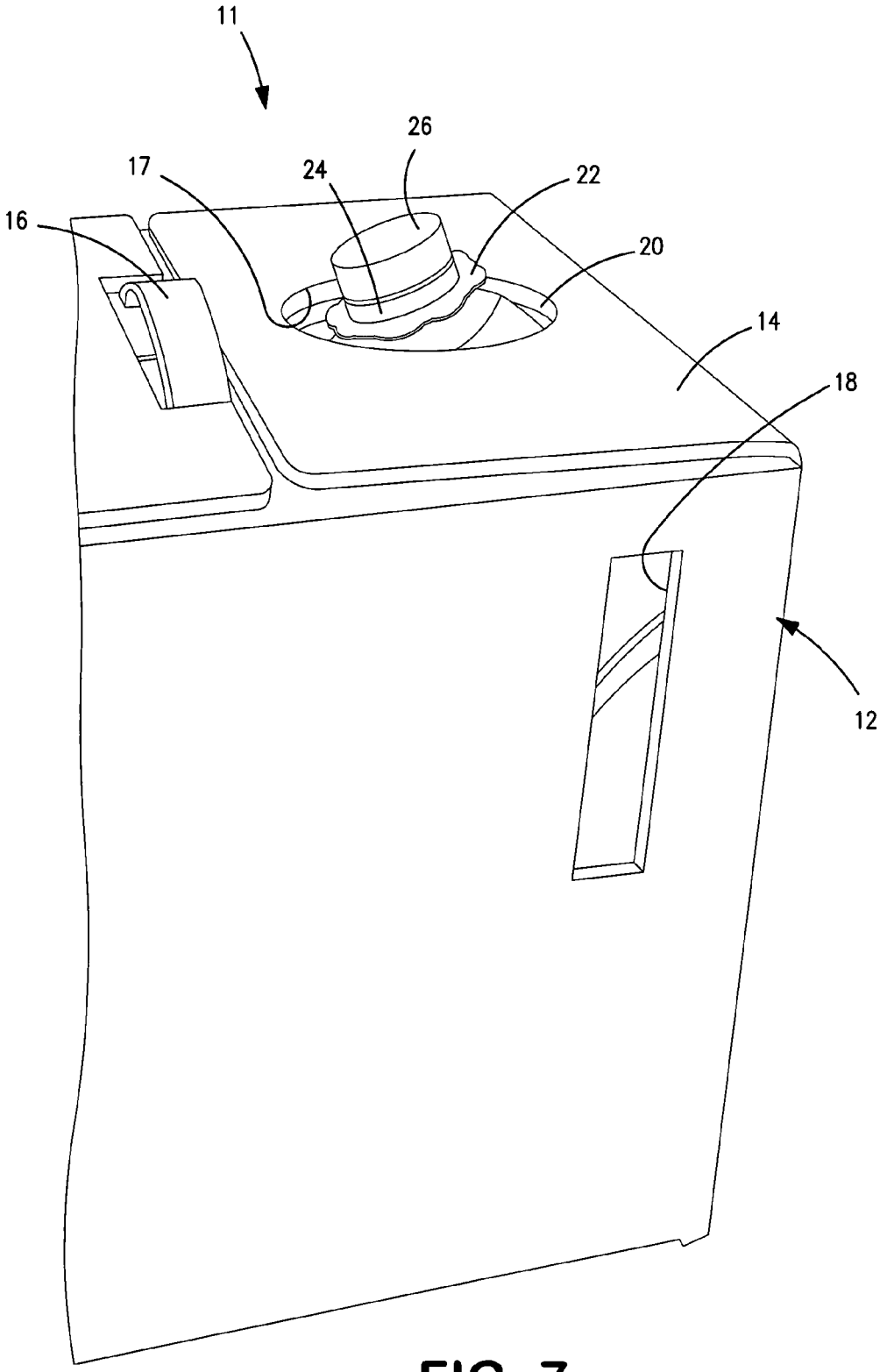
FIG. 7 is a fragmentary perspective view of the packaging module of FIG. 6 from a second side thereof.
Figure 8:
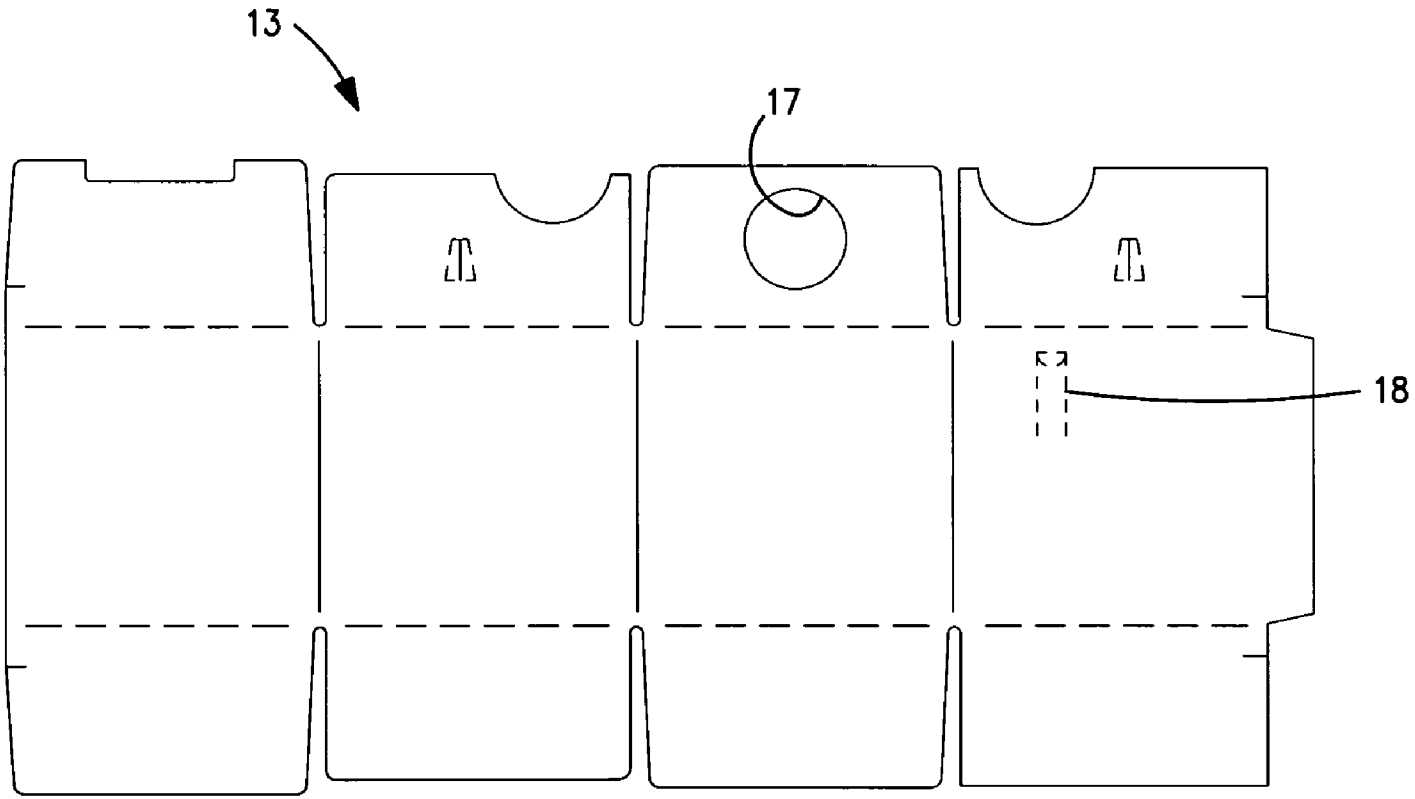
FIG. 8 is a plan view of a pre-assembled form for an outer portion of the packaging module of FIG. 6.

With reference to FIGS. 6-8, in one preferred embodiment, a packaging module unit 11 comprises an outer container body or carton 12 and an inner bag member or bladder 20 (only partially illustrated). The inner bladder 20 is made of a water-impermeable flexible sheet material and has a spout 22 which is closed by a threaded cap 24. As described below, the cap 24 is valved and adapted for efficient connection with a conduit. The spout 20 may be truncated and have a reinforced ridged neck portion. The bladder is filled with one part of the adhesive (not illustrated) and, upon filling, substantially occupies the interior volume of the carton 12 and preferably closely conforms to the interior sides of the carton. The carton 12 is preferably a corrugated rigid or semi-rigid, box-like structure manufactured from a die cut panel 13 such as illustrated in FIG. 8. The carton supports and protects the bladder 20 and its contents and also facilitates transportation and handling.

For storage and transportation purposes, the carton 12 includes a top side 14 to which a handle 16 is affixed. The carton also has an opening 16 in side 14 to provide access to the spout 22 and cap 24 of the bladder. Another side of the carton includes an elongated window 18 which extends to a short distance from the top surface to allow inspection of the contents of the bladder and, in particular, the amount of remaining material.

The inner bladder 20 receives and contains the moisture-sensitive material during shipping, use and pre- and post-use storage. Preferably, the inner bladder 20 is manufactured from a durable plastic material which is translucent or transparent to allow the contents to be viewed. It is preferred that the inner bladder 20 has a raised reinforced spout 22 equipped for threading with interior threads of the cap 24. The spout 22 has sidewalls extending upwardly to form a ridged structure to an opening for the bladder. The cap 24 is pre-installed shortly after the adhesive components are placed in the bladder 20.

In another preferred embodiment, the spout 22 is self-sealing either by use of a twist-cap, valve, or similar closing or sealing means. According to this embodiment, the spout 22 is repeatedly sealable so that the material therein remains in substantially the same condition as it was upon the first opening or first use of the material inside the bladder 20.

In another embodiment, the carton 12 has an inside surface (not illustrated) that is covered or coated with a substantially water impermeable membrane so that the inside surface forms a substantially continuous liner member. According to this embodiment, the spout is sealed with the liner member so that any material contained within is substantially protected from moisture. Alternatively, the spout and the membrane defining the liner are manufactured as a one-piece unit.

Figure 1:
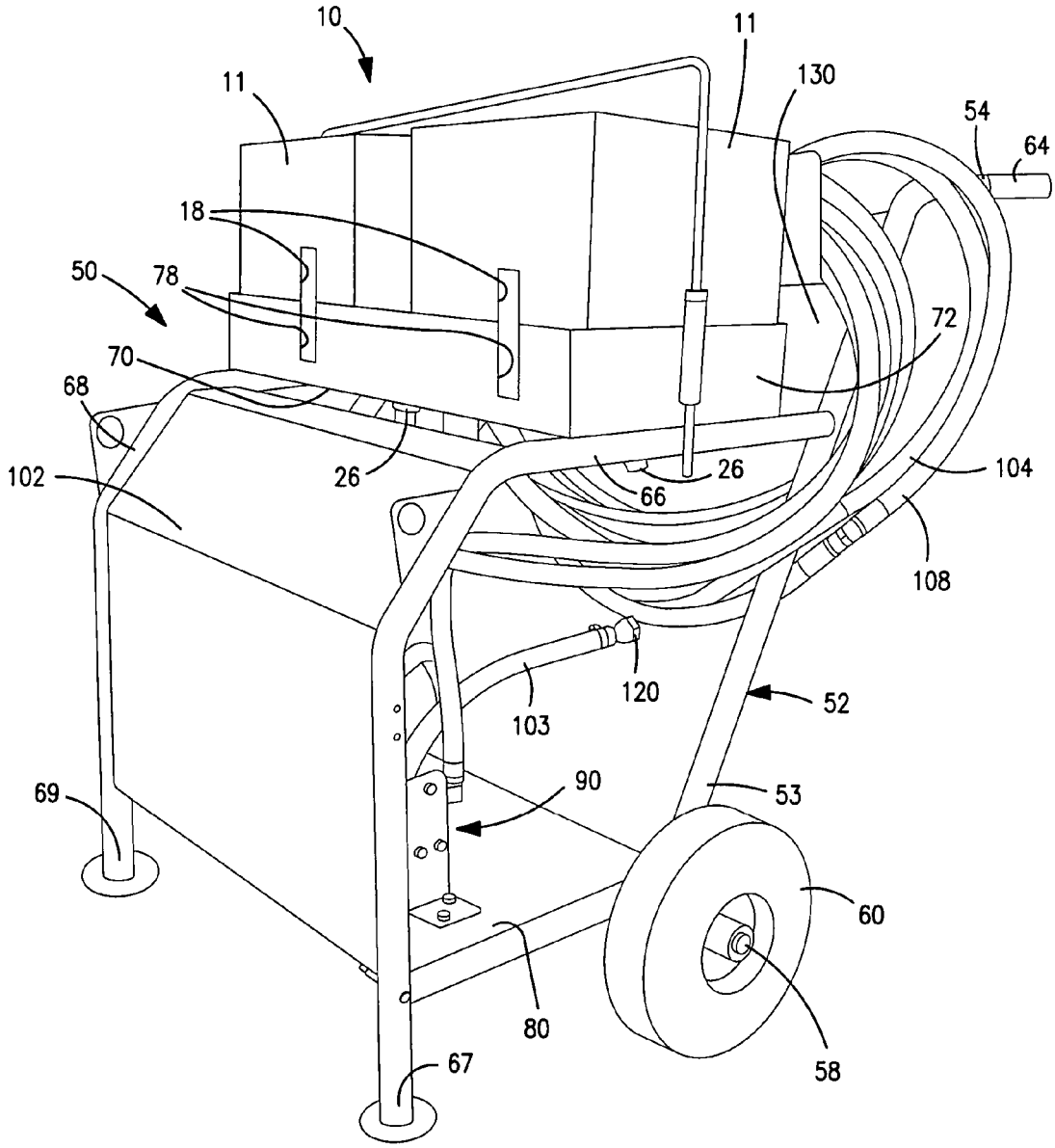
FIG. 1 is a perspective view of an adhesive dispenser system with portions of the system being removed.
Figure 2:
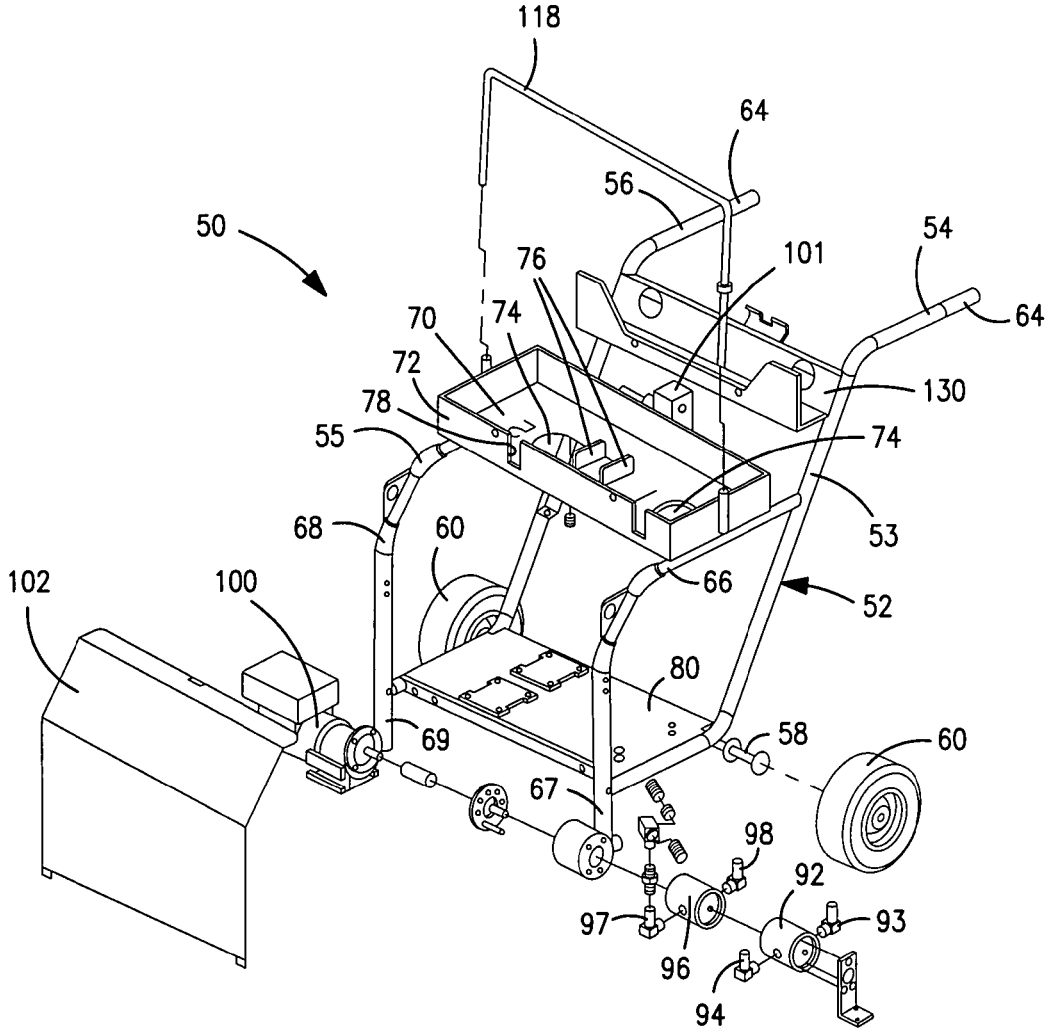
FIG. 2 is an exploded view of a portion of the adhesive dispenser system of FIG. 1.

With reference to FIGS. 1 and 2, the packaging module 11 is especially adapted for incorporation and use in conjunction with a mobile dispenser cart 50. The cart 50 includes a tubular support frame 52 which mounts the various dispenser components and component materials and provides mobility and efficient organization for the dispenser system. The frame 52 includes a pair of laterally spaced, angler tubular supports 53 and 55 which upwardly terminate in handlebars 54 and 56 and, at a lower rear location, receive an axle 58 for a pair of wheels 60. The handlebars angle rearwardly at an upper rear location and include a pair of grips 64 to facilitate manual movement of the cart. A pair of laterally spaced angled tubular supports 66 and 68 extend forwardly from a medial location of the handlebars and extend downwardly to terminate at a pair of support legs 67 and 69. The legs provide a stable support for the cart and allow the cart to be pivotally tilted for movement of the cart in hand-truck fashion whereby the wheels 60 support the cart and facilitate rolling movement.

A lateral, generally horizontal tray 70 is mounted to the support arms. The tray has a circumferential upstanding retaining flange 72. The tray has openings 74 (FIG. 2) as well as a pair of spaced centrally located upright position guides 76. A pair of forward laterally spaced slots 78 are also formed in the retention flange 72.

Figure 3:
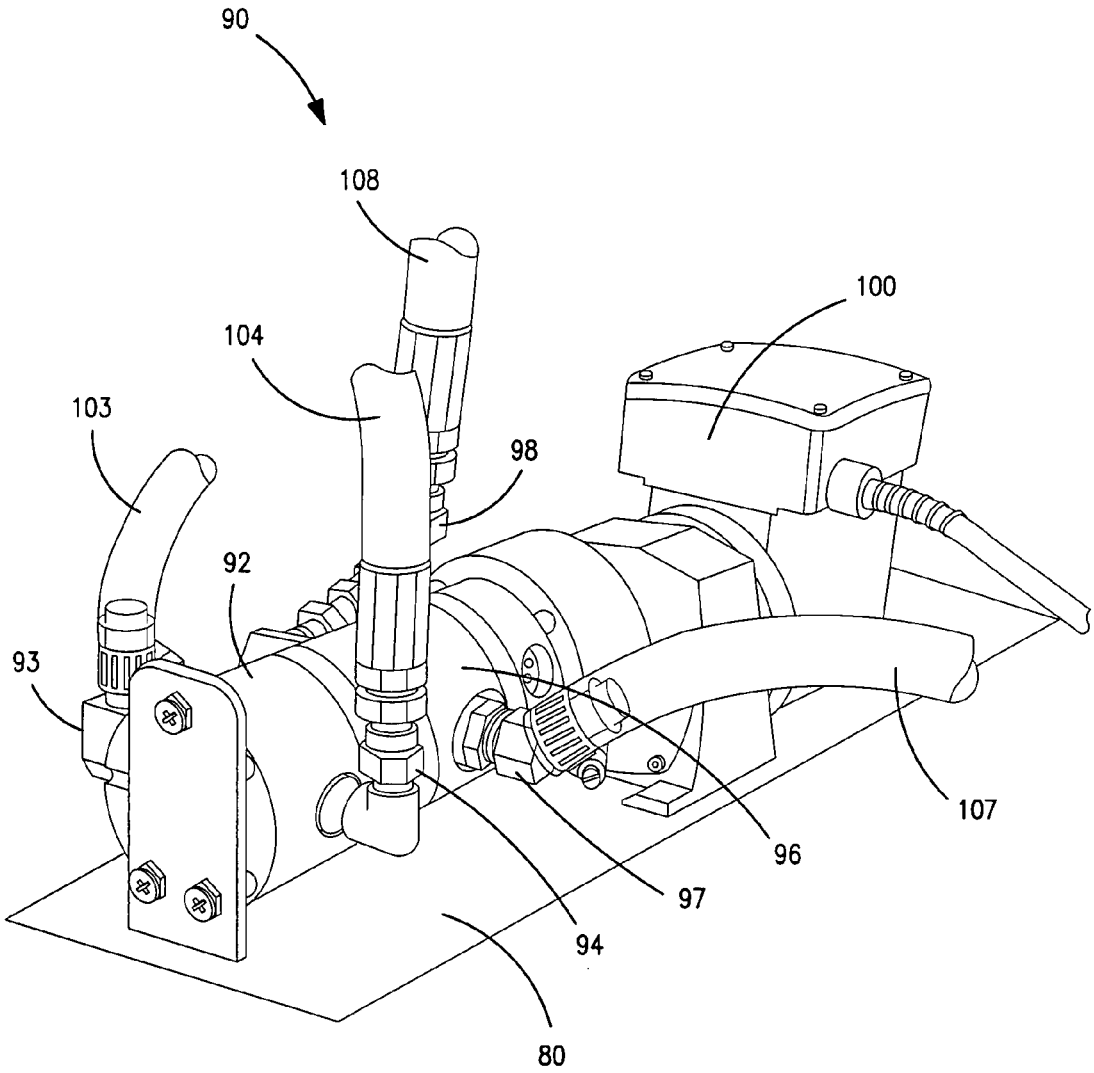
FIG. 3 is an enlarged fragmentary perspective view of a portion of the adhesive dispenser system of FIG. 1, viewed generally from the rear.

With additional reference to FIG. 3, a shelf 80 extends between the supports 53 and 55 at a lower forward position adjacent the joining with supports 66 and 68 to form a generally horizontally disposed support platform. A dual inline geroter pump assembly 90 is mounted to the lower support platform. A pump unit 92 has an inlet 93 and an outlet 94. Pump unit 96 (mounted in reverse relationship to pump unit 92) has an inlet 97 and an outlet 98. Inlets 93 and 97 communicate and connect via connectors with respective transparent conduits 103 and 107 which communicate with the packaging units 11 so that each part of the adhesive is generally supplied under gravity to the respective pump unit. Outlet fittings 94 and 98 connect with the dispensing/delivery hoses 104 and 108. The pump units are driven by an electric motor 100 which is controlled by a control module 101 mounted to the rear of the tray. A skirt 102 may be mounted to the front of supports 66 and 68 to generally enclose and protect the various conduits and the pump assembly 90.

Figure 4:
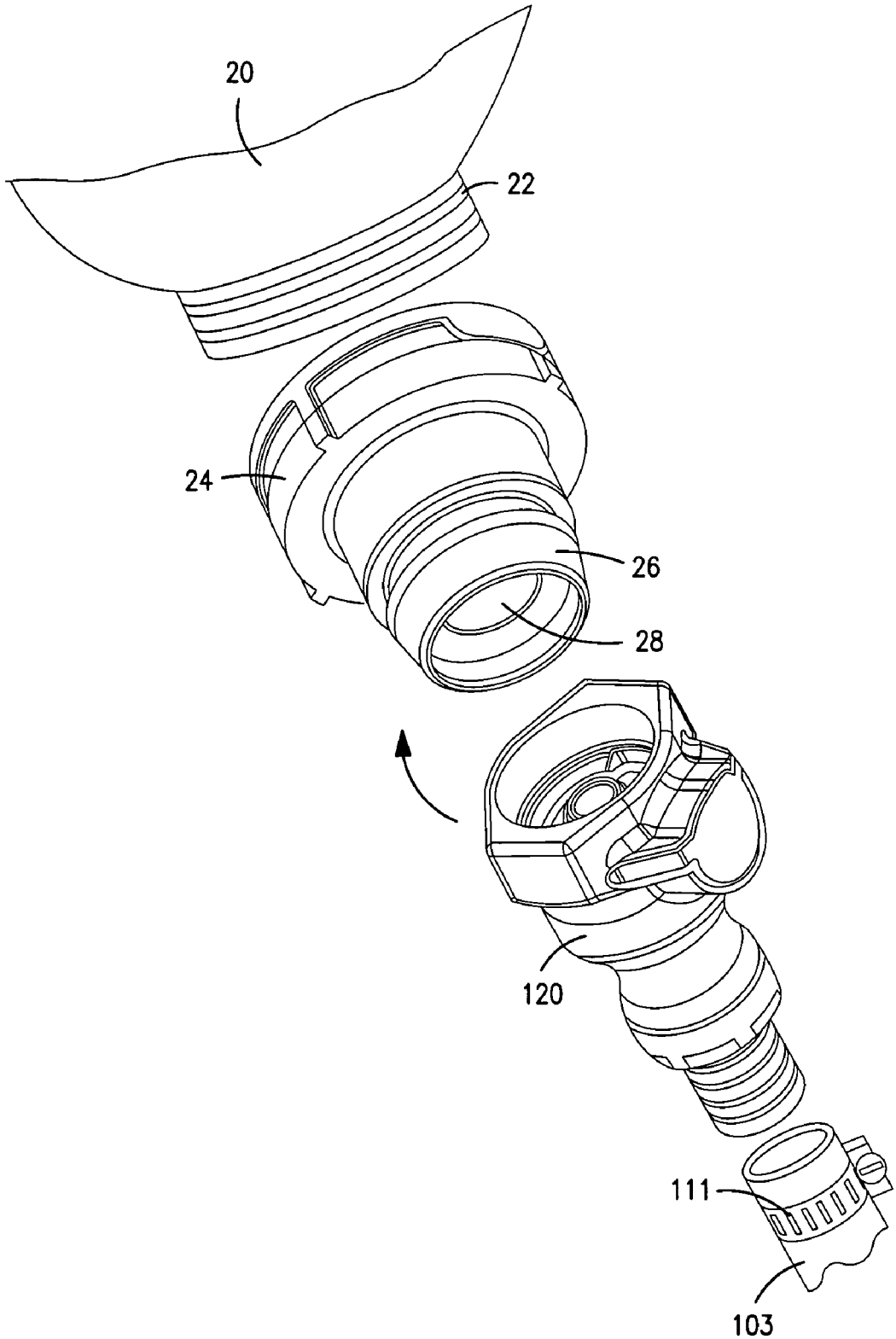
FIG. 4 is an enlarged fragmentary perspective view, partly exploded and partly in schematic, illustrating a portion of the adhesive dispenser system of FIG. 1.
Figure 5:
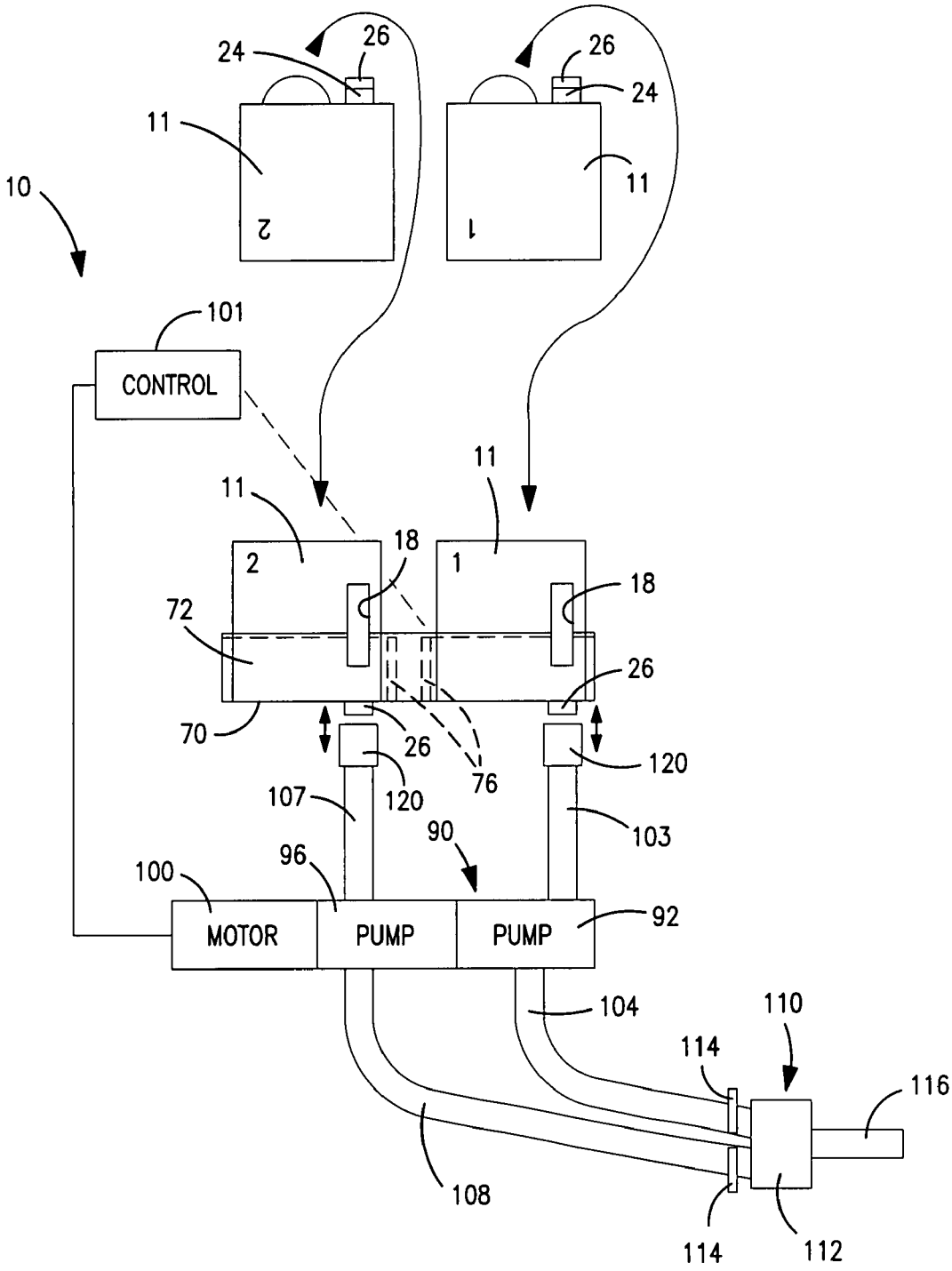
FIG. 5 is a schematic view illustrating the operation of an adhesive delivery system.

With additional reference to FIG. 5, the tray 70 is dimensioned and configured for receiving respective cartons 11 for the first and second parts of the adhesive. With additional reference to FIG. 4, the cartons are configured for usage and connection by the cap 24 which has a projecting male fitting 26 and an intermediate poppet valve 28. The carton is then inverted so that the top side 14 rests on the tray. The carton is positioned so that the projecting male fitting 26 is received in the tray opening 74 or alignable therewith. The window 18 of the carton preferably essentially aligns with a slot 78 of the tray. An upstanding guide 76 engages one side of the carton to facilitate proper positioning. The same process is repeated for the carton 11 of the other part (for a two part adhesive).

An inverted U-shaped retention bar 118 is then mounted over the top of the tray and each module 11 to secure them in position. For applications where only one part is moisture sensitive, only one packaging module 11 may be employed.

Conduits 103 and 107 respectively extend from each inlet 93 and 97 and at an opposite end mount via a hose clamp 111 a female fitting 120. Fitting 120 couples with the cap fitting 26 to provide an efficient snap fit connection and open the poppet valve 28 for providing a flow connection from the container bladder to the conduit without exposure to the atmosphere. The fittings which provide for the connection may be similar to that disclosed in U.S. Pat. No. 5,911,403, the disclosure which is incorporated herein by reference.

Hoses 104 and 108 connect with a mixing nozzle 110. In one embodiment the hoses 104 and 108 are each approximately 30 feet in length. Each of the cartons may thus be connected to the pump assembly and ultimately the dispensing hoses 104 and 108 and the mixing gun assembly 110 without exposure to the atmosphere (and disconnected from the packaging module contents). The dispensing hoses 104 and 108 extend from the pump outlets 94 and 98 to provide a delivery conduit for delivery of the adhesive parts to the mixer 112. The hoses each preferably have lever operated valve 114 at the input openings to the mixer 112. Upon mixture of the constituent two parts, the adhesive is forced under pressure through a dispensing fixture or nozzle, such as representative wand 116 which includes a helical output path.

A bracket 130 may traverse at an upper location between the supports 53 and 55 to provide a retaining support for coiling the hoses 104 and 108 and/or power cords. The control module 101 including a switch is mounted at the rear of the tray to provide an accessible control unit for operating the pump assembly 90.

It should be appreciated that in the event it is necessary to replace one of the components for the adhesive, replacement is relatively efficiently accomplished by disengaging the snap fit connectors 26, 120 which, due to the poppet valve nature, does not expose the adhesive components to the atmosphere, and replacing the carton 11 with another suitable carton 11 as previously described. The pump assembly may be powered, in some instances by a gas engine (not illustrated).

What is claimed:

1. An adhesive product unit comprising a first packaging module and a second packaging module, each said packaging module comprising:

a carton having a box-like shape with one side having an opening;

a water impermeable enclosure disposed in said carton and having a spout defining a central communication axis and alignable with or disposed in said opening and enclosed by a cap disposed about said axis and having a poppet valve biased forwardly into a closed position and a male fitting extending forwardly from said poppet valve and interiorly forming a flow path from said cap;

said first packaging module having a part 1 component disposed in said enclosure and said part 1 component flows along a generally axial path from said cap upon opening said poppet valve;

said second packaging module having a moisture sensitive part 2 component disposed in said enclosure, and said part 2 component flows along a generally axial path from said cap upon opening said poppet valve, wherein said part 1 component and said part 2 component are mixable to form an adhesive.

2. The adhesive product unit of claim 1 wherein at least one of said first packaging module and said second packaging module has a second side of a carton with a cut-out portion defining a window.

3. The adhesive product unit of claim 1 wherein at least one of said first packaging module and said second packaging module comprises a handle extending from one side.

4. The adhesive product unit of claim 1 wherein at least one of said first packaging module and said second packaging module comprises a carton having a corrugated construction.

5. The adhesive product unit of claim 1 wherein at least one of said first packaging module and said second packaging module comprises an enclosure formed of plastic.

6. The adhesive product unit of claim 1 wherein at least one of said first packaging module and said second packaging module comprises an enclosure which is transparent or translucent to allow the component to be viewed exteriorly of said enclosure.

7. The adhesive product unit of claim 1 and further comprising a conduit with a female fitting for receiving said male fitting of one said packaging module in snap-fit relationship.

8. The adhesive product unit and conduit of claim 7 wherein said female fitting comprises a stem member which engages said poppet valve of one said packaging module to open said valve.

9. The adhesive product unit of claim 1 wherein said first packaging module and said second packaging module each has a second side of a carton with a cut-out portion defining a window.

10. The adhesive product unit of claim 1 wherein said first packaging module and said second packaging module each has a handle extending from said one side.

11. The adhesive product unit of claim 1 wherein said first packaging module and said second packaging module each comprises a carton having a corrugated construction.

12. The adhesive product unit of claim 1 wherein said first packaging module and said second packaging module each comprises an enclosure formed of plastic.

13. The adhesive product unit of claim 1 wherein said first packaging module and said second packaging module each comprises an enclosure which is transparent or translucent to allow the component to be viewed exteriorly of said enclosure.

14. The adhesive product unit of claim 1 and further comprising two conduits each with a female fitting for receiving a said male fitting of a said packaging module in snap-fit relationship.

15. The adhesive product unit and conduits of claim 14 wherein each said female fitting comprises a stem member which engages a said poppet valve of a said packaging module to open a said valve.

16. An adhesive product unit comprising:

a first packaging module comprising:

a carton having a box-like shape with one side having an opening;

a water impermeable enclosure disposed in said carton and having a spout defining a central communication axis and alignable with or disposed in said opening and enclosed by a cap disposed about said axis and having a poppet valve biased forwardly into a closed position and a fitting extending forwardly from said poppet valve and interiorly forming a flow path from said cap; and a part 1 adhesive component disposed in said enclosure; and a second packaging module comprising:

a carton having a box-like shape with one side having an opening and being substantially identical to said carton of said first packaging module;

a water impermeable enclosure disposed in said carton and having a spout defining a central communication axis and alignable with or disposed in said opening and enclosed by a cap disposed about said axis and having a poppet valve biased forwardly into a closed position and a fitting extending forwardly from said poppet valve and interiorly forming a flow path from said cap;

a moisture sensitive part 2 adhesive component disposed in said enclosure;

wherein said part 1 adhesive component and said part 2 adhesive component are mixable to form an adhesive.

17. An adhesive product unit comprising:

a first packaging module comprising:

a carton having a box-like shape with one side having an opening;

a water impermeable enclosure disposed in said carton and having a spout defining a central communication axis and alignable with or disposed in said opening and enclosed by a cap disposed about said axis and having a valve biased into a closed position; and a part 1 adhesive component disposed in said enclosure; and a second packaging module comprising:

a carton having a box-like shape with one side having an opening identical in size and shape to the carton of said first packaging module;

a water impermeable enclosure disposed in said carton and having a spout defining a central communication axis and alignable with or disposed in said opening and enclosed by a cap disposed about said axis and having a valve biased into a closed position;

a moisture sensitive part 2 adhesive component disposed in said enclosure;

wherein said part 1 adhesive component and said part 2 adhesive component are mixable to form an adhesive.

* * * * *